US006474834B2

(12) United States Patent
Lai

(10) Patent No.: US 6,474,834 B2
(45) Date of Patent: Nov. 5, 2002

(54) FLASHLIGHT WITH WATERPROOF SWITCH

(75) Inventor: Larry Lai, Chia Yi (TW)

(73) Assignee: Plum Industrial Co., Ltd. (TW)

( * ) Notice: Subject to any disclaimer, the term of this patent is extended or adjusted under 35 U.S.C. 154(b) by 0 days.

(21) Appl. No.: 09/781,243

(22) Filed: Feb. 13, 2001

(65) Prior Publication Data

US 2002/0109987 A1 Aug. 15, 2002

(51) Int. Cl.[7] ..... F21L 4/04
(52) U.S. Cl. ..... 362/206; 200/302.2
(58) Field of Search ..... 362/206; 200/302.2

(56) References Cited

U.S. PATENT DOCUMENTS 3,586,810 A * 6/1971 Brown ..... 200/302.2
4,170,104 A * 10/1979 Yamagata ..... 200/302.2
4,823,242 A * 4/1989 Maglica et al. ..... 200/60
4,841,417 A * 6/1989 Maglica et al. ..... 362/187
4,940,860 A * 7/1990 Shiau ..... 200/302.2
4,956,755 A * 9/1990 Maglica et al. ..... 362/206
5,063,277 A * 11/1991 Takano et al. ..... 200/302.2
5,211,471 A * 5/1993 Rohrs ..... 200/302.2
5,601,359 A * 2/1997 Sharrah et al. ..... 362/188
5,629,105 A * 5/1997 Matthews ..... 200/50.04
5,752,764 A * 5/1998 Shiau ..... 200/526
5,990,430 A * 11/1999 Shiau ..... 200/302.2
6,283,611 B1 * 9/2001 Sharrah et al. ..... 362/158
6,296,371 B1 * 10/2001 Shiau ..... 200/60
6,347,878 B1 * 2/2002 Shiao ..... 362/157

* cited by examiner

*Primary Examiner*—Sandra O'Shea
*Assistant Examiner*—Ismael Negron
(74) *Attorney, Agent, or Firm*—Larson & Taylor, PLC

(57) ABSTRACT

A push-type flashlight comprises a barrel, a lamp shield assembly, a lamp seat assembly, and a switch device. The lamp shield assembly comprises a waterproof sleeve for threadedly and tightly engaging with a reflective member and thus retaining the reflective member in the lamp shield. The switch device comprises a pusher cap that is threadedly and tightly engaged with an insulating sleeve in the switch member. O-rings are respectively mounted to an upper end and a lower end of an outer periphery of the barrel to thereby provide the required pressure-tight and waterproof effects.

5 Claims, 3 Drawing Sheets

FLASHLIGHT WITH WATERPROOF SWITCH

BACKGROUND OF THE INVENTION

1. Field of the Invention

The present invention relates to a push-type flashlight with pressure-tight and waterproof functions.

2. Description of the Related Art

Policemen, firemen, and rescuers generally use a push-type flashlight providing strong lights for illumination. Such a flashlight, when in use, is more apt to be subjected to impact and/or be used in watery area, both of which increases the possibility of intrusion of water that would lead to rusting of metal elements of the flashlight. In addition, the water entering the flashlight would be vaporized by high temperature of the strong lamp and the vapor of water is accumulated to the lens located in front of the reflective member, resulting in reduction in the illumination intensity.

FIGS. 5 and 6 illustrates two conventional flashlights, respectively. Each of the conventional flashlights shown in FIGS. 5 and 6 includes an O-ring 75 between the lens 71 and the lamp shield 72 and another O-ring 75 between the switch means 73 and the barrel 74. It was, however, found that the flashlights with such O-ring arrangements couldn't provide pressure-tight and waterproof functions effectively. As a result, water still permeates into the flashlight.

SUMMARY OF THE INVENTION

It is the primary object of the present invention to provide a push-type flashlight that is pressure-tight and waterproof to lengthen longevity the flashlight, thereby reducing the utility cost for the flashlight.

A push-type flashlight in accordance with the present invention comprises a barrel, a lamp shield assembly, a lamp seat assembly, and a switch means. The lamp shield assembly comprises a waterproof sleeve for threadedly and tightly engaging with a reflective member and thus retaining the reflective member in the lamp shield. The switch means comprises a pusher cap that is threadedly and tightly engaged with an insulating sleeve in the switch member. O-rings are respectively mounted to an upper end and a lower end of an outer periphery of the barrel to thereby provide the required pressure-tight and waterproof effects.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
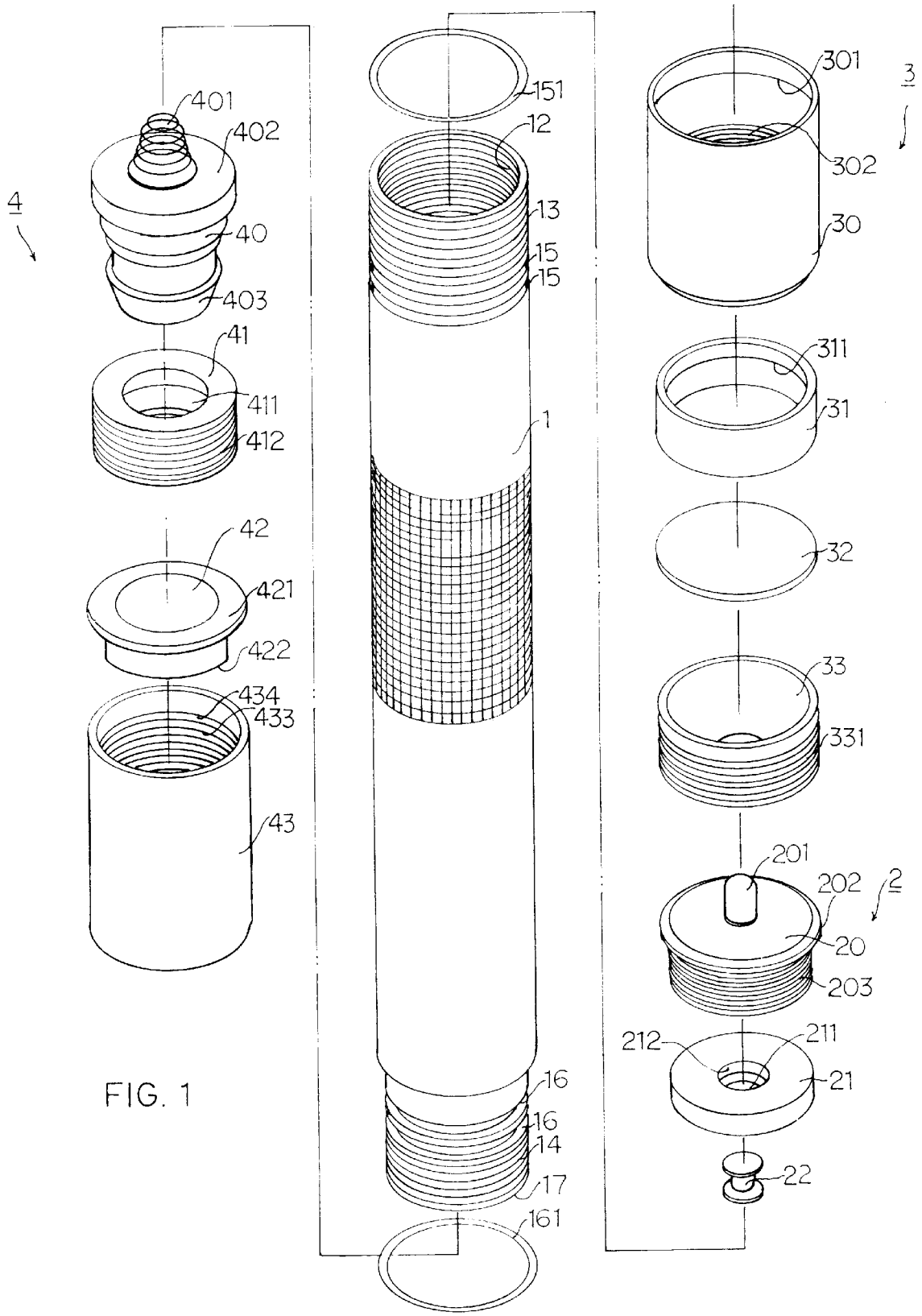
FIG. 1 is an exploded perspective view of a push-type flashlight in accordance with the present invention.
Figure 2:
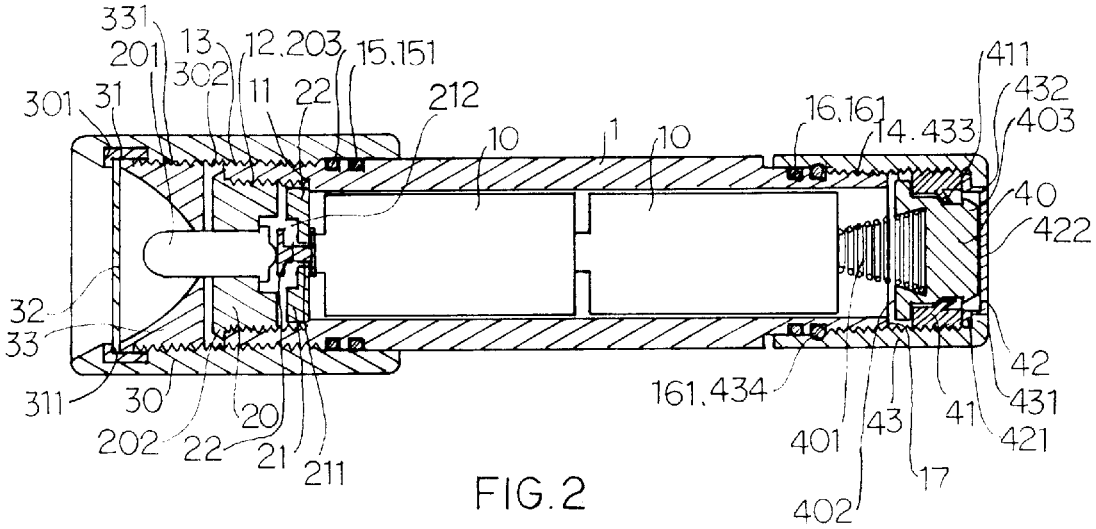
FIG. 2 is a longitudinal sectional view of the push-type flashlight in accordance with the present invention.

Referring to FIGS. 1 through 4 and initially to FIGS. 1 and 2, a push-type flashlight in accordance with the present invention generally includes a barrel 1, a lamp seat assembly 2, a lamp shield assembly 3, and a switch means 4.

The barrel 1 is made from electrically conductive metal to form a hollow barrel for receiving a battery unit (two dry cells 10 in this embodiment) therein. A shoulder 11 is formed on a front end of an inner periphery of the barrel 1. The front end of the inner periphery of the barrel 1 further includes an inner threading 12. The front end of an outer periphery of the barrel 1 includes an outer. threading 13 and the rear end of the outer periphery of the barrel 1 includes an outer threading 14. The outer periphery of the barrel 1 further includes an annular groove 15 defined in the front end thereof and adjacent to the outer threading 13 for receiving an O-ring 151. In addition, the outer periphery of the barrel 1 includes an annular groove 16 defined in the rear end thereof and adjacent to the outer threading 14 for receiving an O-ring 161. The O-rings 151 and 161 may prevent water from entering the flashlight.

The lamp seat assembly 2 comprises a lamp seat 20, an insulating plate 21, and an electrically conductive member 22. The lamp seat 20 is made from electrically conductive metal for receiving a lamp 201. A flange 202 is formed on an end of an outer periphery of the lamp seat 20. The lamp seat 20 includes an outer diameter slightly smaller than an inner diameter of the barrel 1 such that the lamp seat 20 can be mounted into the barrel 1 with outer threading 203 on the outer periphery of the lamp seat 20 being threadedly engaged with inner threading 12 of the barrel 1 and with the flange 202 of the lamp seat 20 abutting against a front annular end face of the barrel 1, best shown in FIG. 2. The insulating plate 21 is substantially circular and has a side abutting against the shoulder 11 of the barrel 1. The insulating plate 21 includes a longitudinal through-hole 211 with a countersink 212 in a side thereof An electrically conductive member 22 is mounted in the longitudinal through-hole 211 and has a first end electrically connected to a positive pole (not labeled) of the lamp 201 and a second end extending into the barrel 1 so as to be electrically connected to a positive pole of one of the dry cell 10.

The lamp shield assembly 3 comprises a lamp shield 30, a waterproof sleeve 31, a protective lens 32, and a reflective member 33. The lamp shield 30 is substantially a tubular member made from metal and includes a ledge 301 on an inner periphery thereof for retaining the waterproof sleeve 31 that is made from rubber. The waterproof sleeve 31 is securely mounted to the inner periphery of the lamp shield 30 and includes a ledge 311 for retaining the protective lens 32 in place. The reflective member 33 is made from metal and includes an outer threading 331 for engaging with the inner threading 302 of the lamp shield 30. The outer threading 331 of the reflective member 33 can be forced to engage with the inner threading 302 of the lamp shield 30 by means of using suitable tools to thereby cause the reflective member 33 to push the protective lens 32 to press against the waterproof sleeve 31. Two sides of the protective lens 32 are in tight and intimate contact with the ledge 301 of the lamp shield 30 that is stopped by the ledge 311 and the reflective member 33, respectively. The required pressure-tight and waterproof effects are thus provided.

The inner threading 302 of the lamp shield 30 is threadedly engaged with the outer threading 13 of the barrel 1 to thereby allow adjustment in longitudinal position of the reflective member 33 relative to the lamp seat 20 upon manually rotating the lamp shield assembly 3. Namely, the focus of the flashlight is adjustable.

The switch means 4 includes a switch 40, an insulating sleeve 41, a pusher cap 42, and an end cover 43. The switch 40 is made from electrically conductive metal and includes a side to which an end of a spring 401 is attached. The other end of the spring 401 is attached to a negative pole (not labeled) of the other dry cell 10. The switch 40 further includes an electrically conductive flange 402 on an end of an outer periphery thereof and a flange 403 on the other end of the outer periphery thereof.

The insulating sleeve 41 is made from electrically insulating material and includes an outer threading 412 for threadedly engaging with the end cover 43, thereby positioning the pusher cap 42 and providing the required pressure-tight and waterproof effects. The pusher cap 42 is made from waterproof material, such as rubber. Formed on an inner periphery of the pusher cap 42 is a flange 421 that is pressed against by the insulating sleeve 41 so as to be in tight contact with an inner flange 431 of the end cover 43. The pusher cap 42 includes an operative portion 422 that extends into an opening 432 defined in an outer end face of the end cover 43. Thus, the user may push the operative portion 422 of the pusher cap 42 for actuating the switch 40. The insulating sleeve 41 further includes an inner flange 411 on an inner periphery thereof for stopping the flange 403 of the switch 40, thereby limiting inward movement of the switch 40 upon pushing the operative portion 42 of the pusher cap 42.

The end cover 43 is a substantially hollow member made from electrically conductive metal. The end cover 43 includes an inner threading 433 for threadedly engaging with the outer threading 14 of the rear end of the barrel 1. The end cover 43 further includes an annular groove 434 defined in an inner periphery thereof for receiving an O-ring 161 that provides an indication for proper position of the end cover 43 such that the end cover 43 would not come to a position too close to or too far away from a rear annular end face 17 of the barrel 1.

Figure 3:
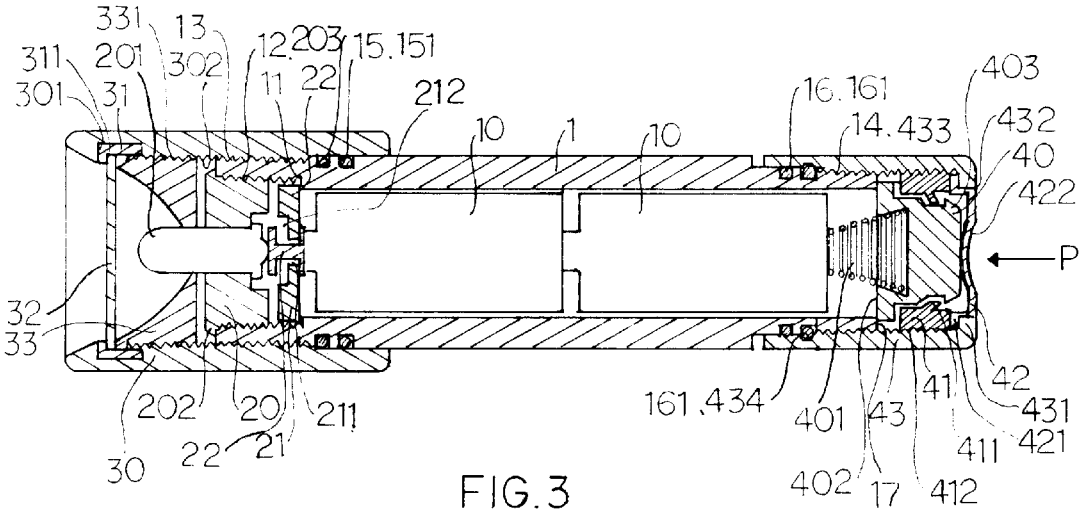
FIG. 3 is a sectional view similar to FIG. 2, wherein the flashlight is in a state for temporary illumination.

In use, referring to FIG. 3, since the positive pole of the lamp 201 is connected to the positive pole of the dry cell 10, when the user intends to use temporary strong light, the user may apply a force P to push the operative portion 422 of the pusher cap 42, which urges the switch 40 forward for a distance until the electrically conductive flange 402 presses against the rear annular end face 17 of the barrel 1. Thus, the lamp 201 illuminates via electrical connection through the barrel 1 and the lamp seat 20 to the negative pole of the dry cell 10. When the force P is released, the electrically conductive flange 402 of the switch 40 no longer presses against the rear annular end face 17 of the barrel 1 and the lamp 201 extinguishes, as illustrated in FIG. 2.

Figure 4:
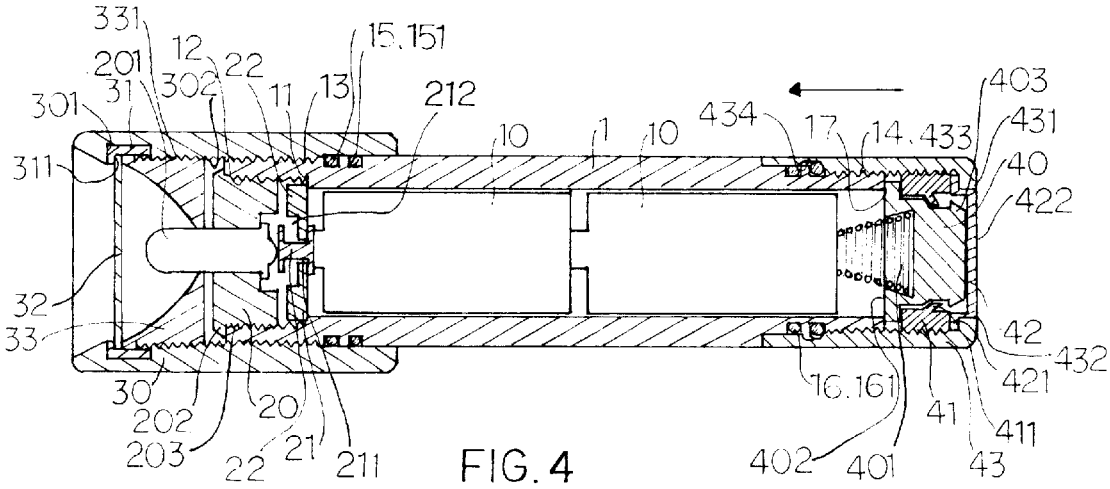
FIG. 4 is a sectional view similar to FIG. 2, wherein the flashlight is in a state for long-term illumination.
Figure 5:
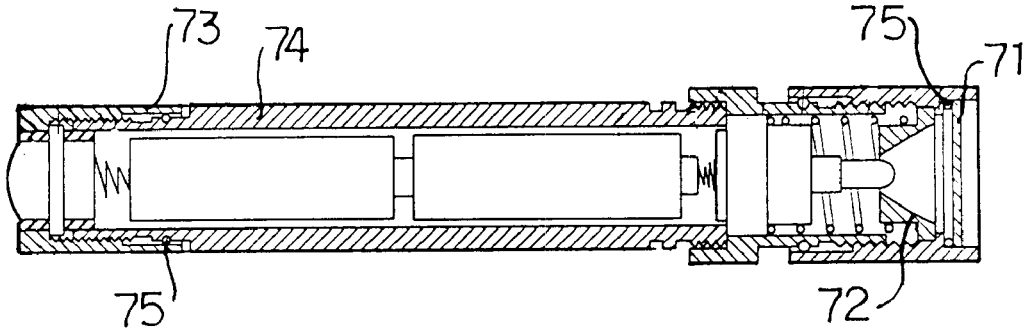
FIG. 5 PRIOR ART
FIG. 5 is a longitudinal sectional view of a conventional flashlight.
Figure 6:
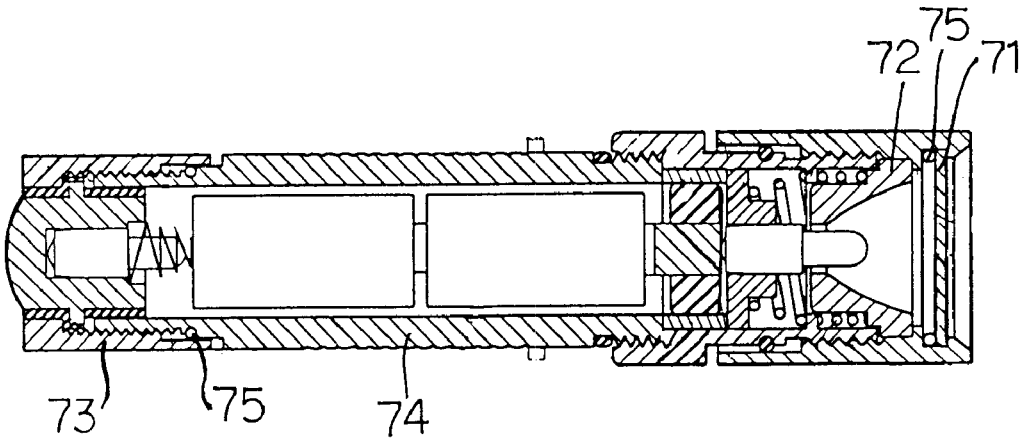
FIG. 6 PRIOR ART
FIG. 6 is a longitudinal sectional view of another conventional flashlight.

Referring to FIG. 4, when long-term strong light illumination is required, the user may directly rotate the end cover 43 until the electrically conductive flange 402 of the switch 40 presses against the rear annular end face 17 of the barrel 1. The lamp 201 illuminates unless the end cover 43 is rotated in a reverse direction which causes disengagement of the electrically conductive flange 402 of the switch 40 from the rear annular end face 17 of the barrel 1.

According to the above description, it is appreciated that the lamp 201 is always engaged on the lamp seat 20, which, in turn, is always in electrical connection with the barrel 1. As a result, the position of the reflective member 33 relative to the lamp seat 20 can be varied by means of manually turning the reflective member 33. Thus, the focus of the flashlight can be altered without affecting electrical connection, thereby preventing disconnection during alternation of the focus of the flashlight.

The O-ring 161 engaged in the annular groove 434 in the inner periphery of the end cover 43 serves as an indication for proper position for the end cover 43 such that the end cover 43 will rot be too far away from the rear annular end face 17 of the barrel 1. Thus, when providing temporary strong light, the only thing the user has to do is to push the operative portion 422 of the pusher cap 42 to urge the switch 40 forward to thereby cause the electrically conductive flange 402 of the switch 40 to press against the rear annular end face 17 of the barrel 1, and the lamp 201 illuminates accordingly via electrical connection through the barrel 1 and the lamp seat 20 to the negative pole of the dry cell 10. In addition, the O-ring 161 may also prevent the end cover 43 from being too close to the lamp 201, which might cause inadvertent illumination of the lamp 201.

The outer threading 331 of the reflective member 33 can be forced to engage with the inner threading 302 of the lamp shield 30 by means of using suitable tools to thereby cause the reflective member 33 to push the protective lens 32 to press against the waterproof sleeve 31. Two sides of the protective lens 32 are in tight and intimate contact with the ledge 301 of the lamp shield 30 that is stopped by the ledge 311 and the reflective member 33, respectively. The required pressure-tight and waterproof effects are thus provided.

The outer threading 412 of the insulating sleeve 41 can be forced to engage with the end cover 43 by means of using suitable tools to thereby retain the pusher cap 42 in place. The flange 421 of the pusher cap 42 is pressed against by the insulating sleeve 41 to be in tight contact with the flange 431 of the end cover 43, thereby providing the required pressure-tight and waterproof effects. Thus, longevity of the flashlight is lengthened and the utility cost for the flashlight is accordingly lowered.

Although the invention has been explained in relation to its preferred embodiment, it is to be understood that many other possible modifications and variations can be made without departing from the scope of the invention as hereinafter claimed.

What is claimed is:

1. A push-type flashlight comprising:

a barrel, a lamp seat assembly, a lamp shield assembly, and a switch means;

the barrel being made from electrically conductive metal for receiving a battery unit, a shoulder being formed on a front end of an inner periphery of the barrel, the front end of the inner periphery of the barrel further including an inner threading, the front end of an outer periphery of the barrel including an outer threading, and the outer periphery of the barrel including an outer threading in a rear end thereof;

the lamp seat assembly comprising a lamp seat, an insulating plate, and an electrically conductive member, the lamp seat being made from electrically conductive metal and receiving a lamp therein, a flange being formed on an end of an outer periphery of the lamp seat, the lamp seat including an outer diameter slightly smaller than an inner diameter of the barrel, the lamp seat including an outer threading on the outer periphery thereof for threadedly engagement with the inner threading of the barrel, the insulating plate being circular and having a side abutting against the shoulder of the barrel, the insulating plate including a longitudinal through-hole, an electrically conductive member being mounted in the longitudinal through-hole and having a first end electrically connected to a positive pole of the lamp and a second end electrically connected to a positive pole of the battery unit;

the lamp shield assembly comprising a lamp shield having an inner periphery, a waterproof sleeve securely mounted to the inner periphery of the lamp shield, a lens, and a reflective member, the lamp shield being a tubular member made from metal and including a ledge on an inner periphery thereof and an inner threading;

the switch means including a switch, an insulating sleeve, a pusher cap, and an end cover, the switch being made from electrically conductive metal and including a side to which an end of a spring is attached, another other end of the spring being attached to a negative pole of the battery unit, the switch further including an electrically conductive flange on an end of an outer periphery thereof and a flange on another end of the outer periphery thereof, the insulating sleeve being made from electrically insulating material and including an outer threading, the pusher cap being made from waterproof material and including an operative portion that extends into an opening defined in an outer end face of the end cover, the end cover being a hollow member made from electrically conductive metal, the end cover including an inner threading for threadedly engaging with the outer threading of the rear end of the barrel, the insulating sleeve further including an inner flange on an inner periphery there of for stopping the flange of the switch, thereby limiting inward movement of the switch upon pushing the operative portion of the pusher cap;

wherein the lamp shield comprises a ledge for retaining the waterproof sleeve, the waterproof sleeve including a ledge for retaining the protective lens, when the reflective member is forced to engage with the lamp shield, the reflective member pushes the protective lens to press against the waterproof sleeve, whereby two sides of the waterproof sleeve are in tight and intimate contact with the ledge of the lamp shield and the protective lens, respectively.

2. The push-type flashlight as claimed in claim 1, wherein the end cover further includes an inner flange on another other end of the periphery thereof, the pusher cap includes a flange that presses against the inner flange of the end cover, wherein the pusher cap is retained in place when the insulating sleeve and the end cover are threadedly engaged together, such that two sides of the flange of the pusher cap are in tight and intimate contact with the insulating sleeve and the inner flange of the end cover, respectively.

3. The push-type flashlight as claimed in claim 1, wherein the end cover further includes an annular groove defined in an inner periphery thereof for receiving an O-ring.

4. The push-type flashlight as claimed in claim 1, wherein the lamp seat is in threading engagement with the inner periphery of the barrel.

5. The push-type flashlight as claimed in claim 1, wherein the reflective member is in threading engagement with the lamp shield.

* * * * *